US005231410A

United States Patent [19]

Murakami et al.

[11] Patent Number: 5,231,410

[45] Date of Patent: Jul. 27, 1993

[54] WINDOW GLASS ANTENNA FOR A MOTOR VEHICLE

[75] Inventors: Harunori Murakami, Machida; Hidetoshi Oka, Zama, both of Japan

[73] Assignee: Nippon Sheet Glass Co., Ltd., Osaka, Japan

[21] Appl. No.: 928,688

[22] Filed: Aug. 12, 1992

Related U.S. Application Data

[63] Continuation of Ser. No. 557,957, Jul. 25, 1990, abandoned.

[30] Foreign Application Priority Data

Aug. 3, 1989 [JP] Japan ..... 1-202008

[51] Int. Cl.[5] ..... H01Q 1/32

[52] U.S. Cl. ..... 343/713; 343/704

[58] Field of Search ..... 343/704, 713

[56] References Cited

U.S. PATENT DOCUMENTS

| | | | |
|---|---|---|---|
| 3,638,225 | 1/1972 | Zawodniak | 343/713 |
| 4,155,090 | 5/1979 | Kuroyanagi et al. | 343/713 |
| 4,439,771 | 3/1984 | Kume et al. | 343/704 |
| 4,954,797 | 9/1990 | Shinnai et al. | 343/704 |
| 5,017,933 | 5/1991 | Sakurai et al. | 343/713 |

FOREIGN PATENT DOCUMENTS

| | | |
|---|---|---|
| 55-140301 | 11/1980 | Japan . |
| 58-70643 | 4/1983 | Japan . |
| 58-138408 | 9/1983 | Japan . |
| 61-30102 | 2/1986 | Japan . |
| 61-73403 | 4/1986 | Japan . |
| 61-100004 | 5/1986 | Japan . |
| 61-203702 | 9/1986 | Japan . |
| 61-175010 | 10/1986 | Japan . |
| 62-201508 | 12/1987 | Japan . |
| 63-129307 | 8/1988 | Japan . |
| 63-133707 | 9/1988 | Japan . |
| 63-269625 | 11/1988 | Japan . |
| 1-86601 | 3/1989 | Japan . |
| 1-106502 | 4/1989 | Japan . |

*Primary Examiner*—Rolf Hille
*Assistant Examiner*—Le Hoanganh
*Attorney, Agent, or Firm*—Woodcock Washburn Kurtz Mackiewicz & Norris

[57] ABSTRACT

A pair of antenna conductors are formed on upper and lower blank portions outside an area where defogging heater wires are attached on a window glass of a motor vehicle. One of the antenna conductors is RF-coupled with the defogging heater wires and a feed terminal thereof is located at a lateral side of the glass. The other antenna conductor has a feed terminal located at another lateral side of the glass. A pair of reception signals complement with each other in directivity due to asymmetric characteristic of the antenna conductors and are used in a diversity reception system for obtaining a nondirectional reception characteristic.

7 Claims, 4 Drawing Sheets

WINDOW GLASS ANTENNA FOR A MOTOR VEHICLE

This is a continuation of application Ser. No. 07/557,957, filed Jul. 25, 1990, now abandoned.

BACKGROUND OF THE INVENTION

1. Field of the Invention

The present invention relates to a glass window antenna for a motor vehicle, wherein antenna conductors are arranged on a surface of a window glass used as an insulator.

2. Description of the Prior Art

In an antenna system of a motor vehicle, a diversity reception using a plurality of antennas is employed for reducing changes in reception gain according to traveling direction of the vehicle. An FM broadcast diversity reception, for example, a pole antenna attached on the body of the motor vehicle and an antenna comprising an antenna conductor attached on a rear glass window are used in a prior art. A space diversity reception is so performed that the highest level one in reception signals is selected (cf. Japanese laid open patent application No. 140301/1985).

It is known to perform diversity reception with two or more antenna conductors and feed terminals on a rear window surface of the motor vehicle (Japanese utility model registration application laid open Nos. 138408/1988 and 29307/1988 and a patent application laid open No. 269625/1988).

As to the pole antenna, tuning adjustment is possible only with regard to its length. It is less flexible in arrangements of conductor than that of a glass window antenna. It is therefore difficult to tune the conductor for providing complementary directivity for diversity reception system. An element of the pole antenna is arranged vertically so that it shows a low reception sensibility to receive horizontally polarized wave.

It is possible to tune directivity of respective antennas in diversity reception system in which spaced conductors arranged on a surface of a glass window. Spaces on the window, however, are little for the antenna conductors so that they show low average reception sensibility. Preamplifiers with fixed gains must be inserted immediately after feed terminals of the antenna conductors. These fixed gain amplifiers often saturate at strong radio wave field so that reception radio voice is remarkably degraded.

OBJECT AND SUMMARY OF THE INVENTION

Accordingly it is an object of this invention to provide window glass antennas which have good complimentary directivities and high reception sensibilities without using preamplifiers.

In accordance with an aspect of the present invention, there is provided a window glass antenna of a motor vehicle comprising heater wires formed in a heating area on a window glass of the motor vehicle; a first antenna conductor formed in a lower blank area outside the heating area; a second antenna conductor formed in a lower blank area outside the heating area and RF-coupled to the heater wires; and first and second feed terminals arranged oppositely at both lateral sides of the window glass for deriving reception signals from the first and second antenna conductors.

According to opposite wiring courses toward the feed terminals, location of the first and second antenna conductors is asymmetrical with respect to a center line of glass window. Directivities of the antenna conductors complement with each other. Non-directional reception characteristic is thus achieved by diversity reception.

The above, and other, objects, features and advantages of the present invention, will become readily apparent from the following detailed description thereof which is to be read in connection with the accompanying drawings.

DETAILED DESCRIPTION OF A PREFERRED EMBODIMENT

Figure 1:
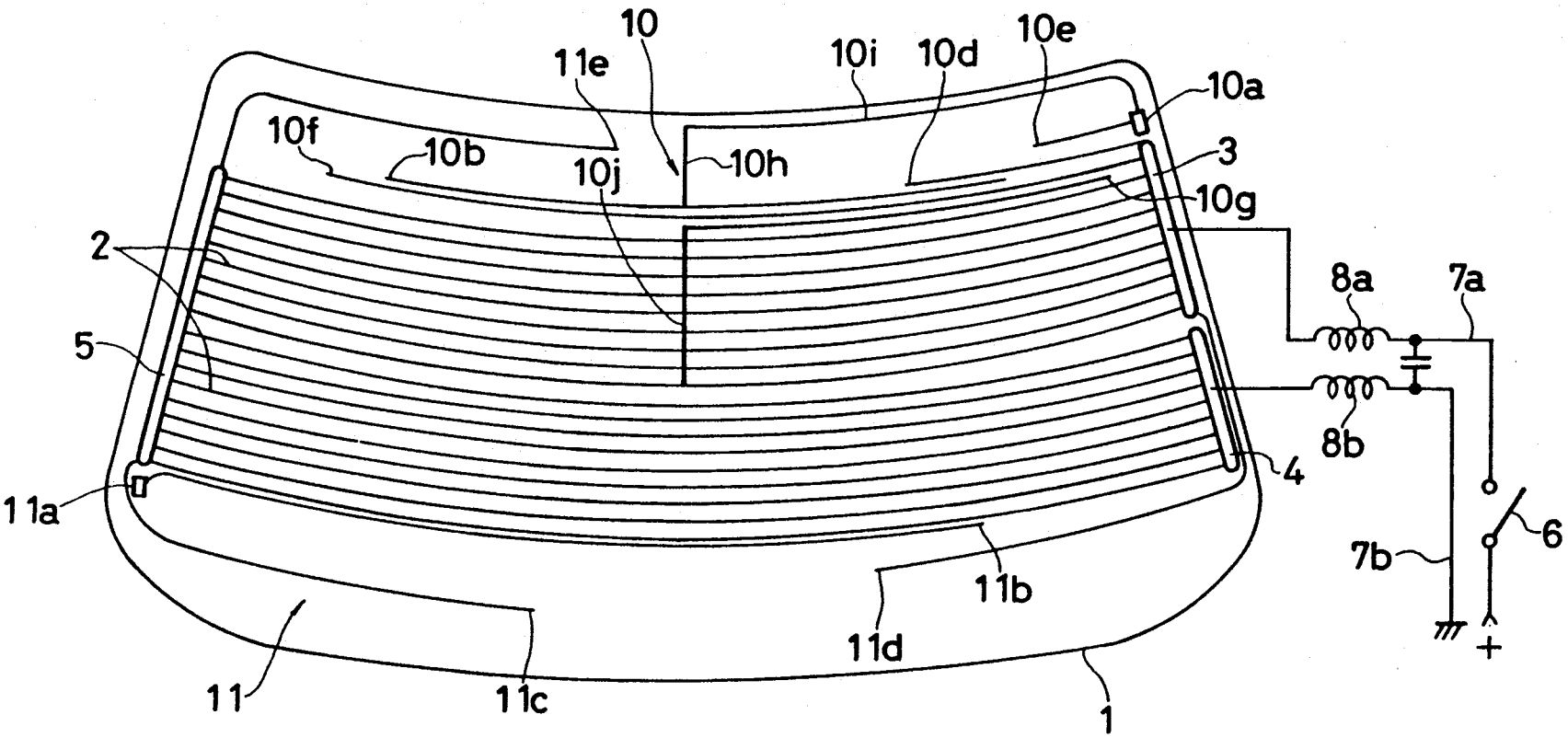
FIG. 1 is a front view of a rear glass window on which a glass window antenna for a motor vehicle according to this invention is provided.

FIG. 1 is shows a rear glass window of a motor vehicle according to this invention. In the middle zone of the glass window, a plurality of defogging heater wires 2 is formed in parallel to each other through a printing and a baking processes. The heater wires 2 are divided into upper and lower groups. Power is fed through bus bars 3 and 4 through a return path via a common bus bar 5. Another power feed system may be arranged in which heater wires 2 are not divided into two groups so that a current flows from a side bus bar to another side bus bar.

The heater wires 2 are used as an AM radio wave reception antenna. Magnetically coupled choke coils 8*a* and 8*b* are inserted into power supply lines 7*a* and 7*b*. The choke coils provides the heater wires 2 with large impedance to ground in radio frequencies. The power supply line 7*a* is coupled to a main power supply through a switch 6 and the power supply line 7*b* is coupled to ground.

Antenna conductors 10 and 11 are arranged on upper and lower blank areas of the heater wires 2. The upper antenna conductor 10 is exclusively used for FM broadcast reception. The lower antenna conductor 11 is used both for AM and FM broadcast receptions. A diversity reception is performed for FM broadcast reception with using the upper and lower antenna conductors 10 and 11.

Asymmetrical arrangement of conductors is employed with respect to the center line of the glass window for satisfactory FM diversity reception. For securing asymmetrical arrangement of the conductors, a feed terminal 10*a* of the upper antenna conductor 10 is located at the right side (viewed from inside of a car) of the glass window 1 and a feed terminal 11*a* of the lower antenna conductor 11 is located at left side.

The antenna conductor 10 comprises horizontal elements 10*b*–10*g*. A main element 10*b* is a single element antenna of about 800 mm in length and is symmetrically arranged with respect to the center line of the glass window 1. At the center of the conductor 10*b*, a vertical coupling conductor 10*h* is connected to form an antenna of generally inverse letter-T configuration. The coupling conductor 10*h* is connected to a feeder line 10*i* arranged along an upper edge of the glass window 1. An end of the feeder conductor 10*i* is connected to the feed terminal 10*a* located at the side end of the glass window 1.

The feeder line 10*i* is 3 mm in width and made wider than other conductors so that impedance matching is satisfied between a feeder cable of 50Ω to be connected to the feed terminal 10*a* and the inverse T-antenna comprising the main element 10*b* and the coupling conductor 10*h*. The feeder line 10*i* has a desired capacitance to ground which is produced by capacitive coupling to a window frame (ground potential) near the upper edge of the glass window. A desired impedance measured at the feed terminal 10*a* is obtained.

Horizontal elements 10*d* and 10*f* are extended from the bus bar 3 of the heater wires 2 in parallel with the main element 10*b*. These horizontal elements are capacitively coupled with the main element 10*b* so as to tune the antenna in directivity. Respective ends of the horizontal elements 10*d* and 10*f* are located at 300 mm and 400 mm away from the center line of the window 1.

A short-circuit conductor 10*j* of 4 mm in width is provided along the center line of the glass window 1 to short all of upper half of the heater wires 2. A horizontal element 10*g* is extended from an end of the couple capacitively with the element 10*h* for improving directivity. An end of the horizontal element 10*g* is located at 500 mm away from the center line of the glass window 1. The short-circuit conductor 10*j* connects equipotential points of the heater wires 2 so that no short-circuiting current actually flows through the short-circuit conductor 10*j*.

In this embodiment, line intervals 10*d*–10*b*, 10*b*–10*f*, 10*f*–10*g* and 10*g*–*heater wires 2 are respectively* 10, 15, 7.5 and 7.5 mm.

A horizontal auxiliary element 10*e* of 165 mm in length is extended from the feed terminal 10*a* so as to tune the antenna in directivity as well as high frequency characteristic.

The above-mentioned elements 10*d*, 10*h*, 10*g* and 10*e* improve reception element 10*b* on the left side thereof. These elements are arranged generally on the right side of the center line of the glass window 1. The antenna conductor 10 is thus arranged asymmetrically in general with respect to the center line of the glass window 1.

The lower antenna conductor 11 has a horizontal main element 11*b* extended from the feed terminal 11*a* in parallel with the heater wires 2 at an interval of 2 mm. The main element 10*b* is capacitively coupled to the heater wires 2 to serve as an antenna used both in receptions of AM and FM waves induced on the heater wires 2. The lower half of the heater wires 2 serves as ground circuitry e.g. a return path of a heater current so that noises in a heater power supply do not propagate directly from the heater wires 2 to the main element 11*b*. No remarkable noises are recognized in a reception signal. An end of the main element 11*b* is located at 210 mm away from the center line of the glass window 1.

Auxiliary horizontal elements 11*c*, 11*d* and 11*e* are extended from bus bars 3 and 5 of the heater wires 2 for improving directivity and frequency characteristics of the main element 11*b*. The heater wires 2 are thus tuned as an antenna. The element 11*c* is extended horizontally from the lower end of the common bus bar 5 by 150 mm away from the center line of the glass window with an interval of 30 mm to the heater wires 2.

The element 11*d* is extended from the lower end of the bus bar 3 along the right side of the glass window 1 and then extended horizontally to a position 410 mm away from the center line of the glass window 1 with an interval of 15 mm to the heater wires 2.

The element 11*e* is extended from the upper end of the common bus bar 5 along a corner portion and upper side of the glass window 1 to a position 150 mm away from the center line.

Figure 2:
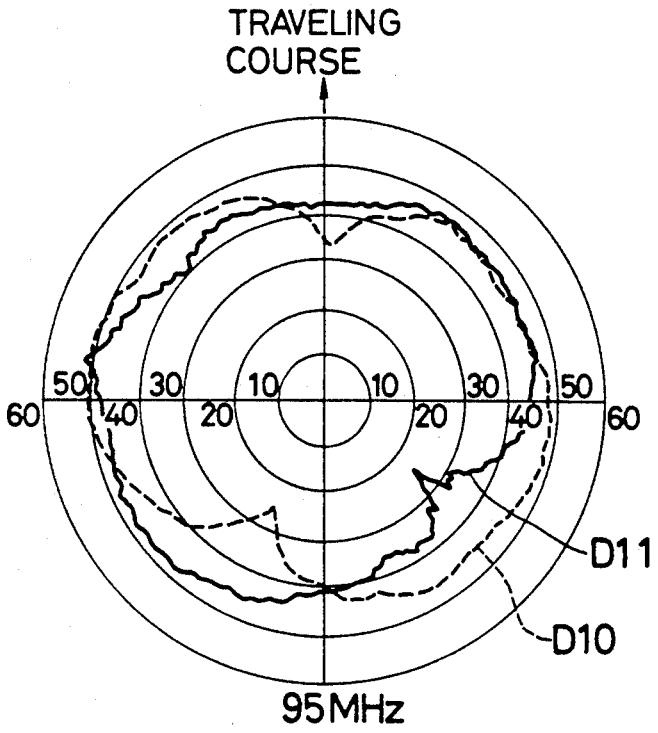
FIG. 2 is a graph showing directivities of upper and lower antenna conductors.

FIG. 2 shows directivity of antenna conductors 10 and 11 with respect to FM broadcast wave of 95 MHz. The directivity of dotted line D11 corresponds to the antenna conductor 10 and the directivity of a solid line D10 corresponds to the antenna conductor 11. As is apparent from the directivity chart, a dip in gain of the lower antenna 11 appearing on the right side of a traveling course of a car is complemented by a gain of the upper antenna conductor 10. In the directivity of the antenna conductor 10, a dip appearing on the left side of a traveling course of a car is complemented by a gain of the lower antenna conductor 11. A diversity reception is achieved by selecting a higher level one of reception signals from the complementary antenna conductors 10 and 11 in response to comparison of these signals. A stable reception signal is obtained regardless of changes of traveling direction of the car.

The lower antenna conductor 11 functions as an AM reception antenna. In this radio band, the heater wires 2 is operable as an antenna conductor since conductors of the wires are relatively long.

Figure 3:
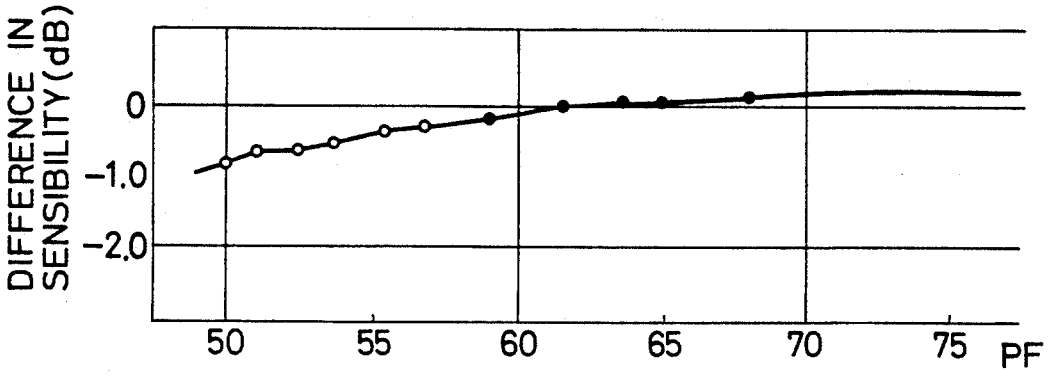
FIG. 3 is a graph showing variation of reception sensibility with respect to coupling capacity between heater wires and the second antenna conductor.

FIG. 3 is a graph showing a relation between AM reception sensibility and coupling capacitance of the main antenna element 11 to the heater wires 2. Differences in sensibility are plotted with reference to that (0 dB) of a rear pole antenna of 1200 mm long. The difference reaches the reference when the coupling capacitance exceeds 60 pF, and saturates at 70 pF or more. In the embodiment, the main element 11*b* and the heater wires 2 are set at an interval of 2 mm to give capacitive coupling not less than 70 pF so that an AM reception signal is obtained by the antenna conductor 11 with a sufficient gain.

Figure 4:
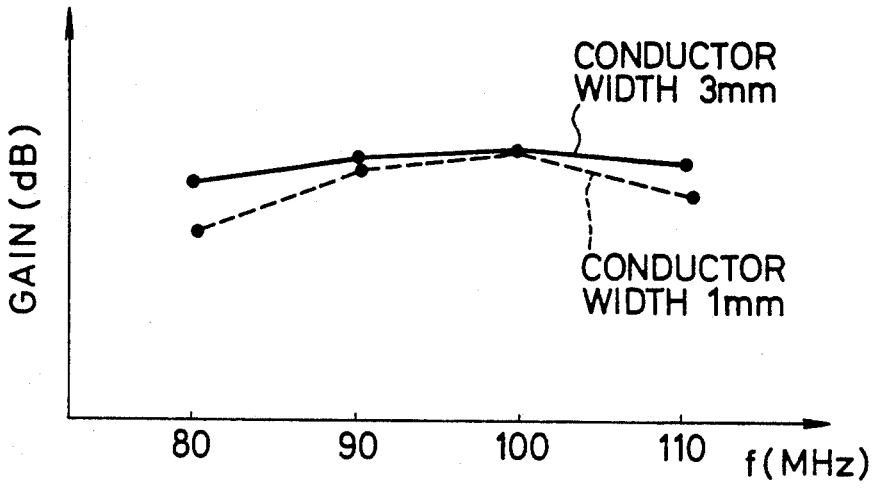
FIG. 4 is a graph showing a gain of the first antenna conductor for various line width of feeder line connected thereto.

FIG. 4 shows reception gains of the upper antenna conductor 10 in FM broadcast wave ranging 80–90 MHz in cases where width of the feeder line 10*i* in FIG. 1 is 1 mm and 3 mm as respectively shown by a dotted line and a solid line. As is apparent from the graph, reception gains in lower side and upper side of FM broadcast band are respectively improved when the width of the feeder conductor 10*i* is set not less than 3 mm. Frequency characteristics are improved over a wide range. The feeder line 10*i* is extended from the center line of the window glass 1 toward right side to the feed terminal 10*a* and operates as an antenna element which serves to improve reception gain on the right side of traveling course.

Figure 5:
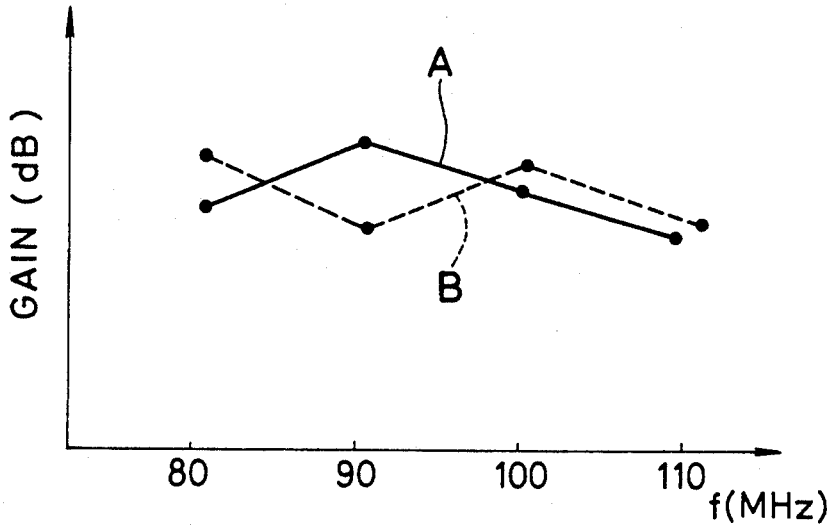
FIG. 5 is a graph showing gain of the second antenna conductor in a case in which a horizontal element is added to a bus bar of heater wires and a case in which the horizontal element is not provided.

FIG. 5 shows reception gains of the lower antenna conductor 11 in a range 80–90 MHz in cases where the horizontal elements 11*c* and 11*e* are extended from the common bus 5 of the heater wires 2 and these elements 11*c* and 11*e* are removed, respectively as shown by a solid line A and a dotted line B. A condition of FM radio wave current induced on the heater wires 2 is changed by extending the elements 11*c* and 11*e* from the common bus bar 5 of the heater wires 2, frequency bands each in which a good sensibility is obtained are shifted to each other as shown by the graph. These elements 11*c* and 11*e* are arranged on the left side of the glass window 1 so that it operates to improve reception gain of the lower antenna conductor 11 on the left side of the traveling course.

Figure 6:
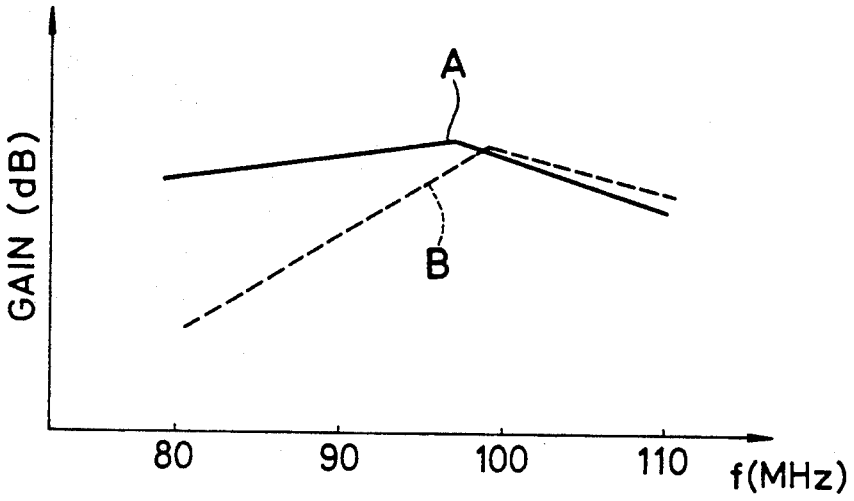
FIG. 6 is a graph showing gain of antenna in a case in which short-circuit conductor and horizontal elements are added and another case in which these are not provided.

FIG. 6 shows gain characteristics in a band of 80–110 MHz for a case (solid line A) where the short-circuit conductor 10*j* is provided to the heater wires in FIG. 1 and the horizontal element 10*g* is extended from an end of the conductor 10*j* in parallel to the heater wires 2, and another case (dotted line B) where these conductors 10*j* and 10*g* are not used. State of FM radio frequency current induced on the heater wires 2 is changed by attaching these conductors 10*j* and 10*g*. Frequency band having good sensibility can be shifted as shown by the graph. The horizontal elements 10*g* is extended on the left side of the glass window 1 so that it operates to improve reception gain of the upper antenna conductor 10 on the left side of the traveling course.

Figure 7:
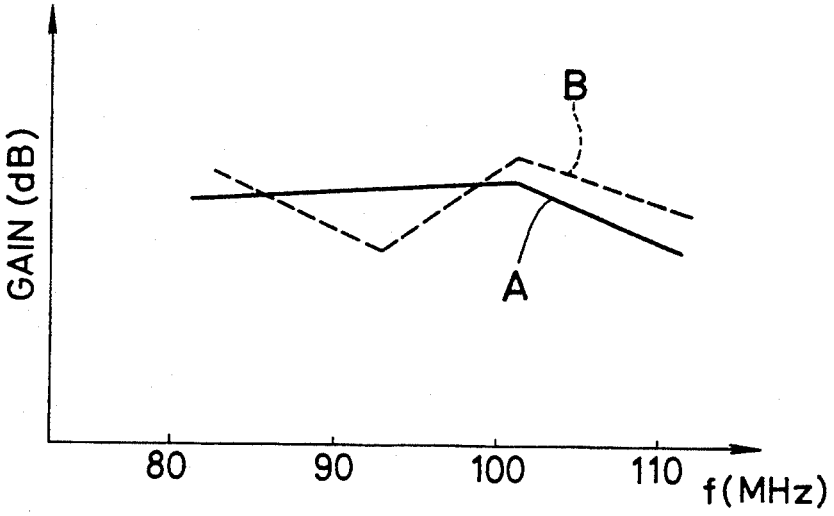
FIG. 7 is a graph showing gain of antenna in a case in which horizontal element is provided to capacitively couple to the first antenna conductor and another case in which the horizontal element is not provided.

FIG. 7 shows reception gains in a band of 80–110 MHz in a case (solid line A) where the horizontal elements 10*d* and 10*f* are extended from the bus bar 3 of the heater wires 2 as shown in FIG. 1 to capacitively couple with the main element 10*b* on both sides (upper and lower sides) thereof and another case (dotted line B) where the elements 10*d* and 10*f* are not used. Influence to the main element 10*b* by the heater wires 2 can be changed by capacitive coupling of horizontal elements 10*d* and 10*f* with the main element 10*b* at a distance within 15 mm. Frequency band having good sensibility can be shifted as shown by the graph. These horizontal elements 10*d* and 10*f* operate to improve a gain of the upper antenna conductor 10 on the right side of a traveling course.

According to this invention, due to asymmetrical arrangement of the first and second antenna conductors with respect to the center of the glass window, directivities complementing to each other are obtained. Good reception characteristics are obtained with diversity reception regardless of traveling direction of car. Especially, a reception system in which any preamplifier is not employed can be arranged so that a reception signal of high quality is received without distortion even in a strong radio wave field.

According to other features of this invention, reception gains of the first and second antenna conductors are improved. Complementary characteristics of the firs and second antenna elements are ensured to operate a diversity reception system with high performance.

What is claimed is:

1. A window glass antenna of a motor vehicle comprising:

heater wires formed in a heating area on a window glass of the motor vehicle;

a first antenna conductor comprising a single horizontal element and a vertical element forming an inverse T shape in an upper blank area outside of the heating area;

a second antenna conductor formed in a lower blank area outside of the heating area and RF-coupled to said heater wires;

first and second feed terminals arranged oppositely at both lateral sides of the window glass for deriving reception signals from said first and second antenna conductors; and means for impedance matching between said first antenna conductor and said first feed terminal including a feeder line of about 3 mm is width connecting a central feed point of said first antenna conductor along an upper edge of said window glass with said first said terminal.

2. A window glass antenna according to claim 1, wherein a line conductor coupled capacitively to said first antenna conductor is extended from a bus bar of the heater wires on the side where said first feed terminal is arranged.

3. A window glass antenna according to claim 2, wherein said line conductor consists of two elements arranged along upper and lower sides of the first antenna conductor.

4. A window glass antenna according to claim 1, further comprising:

a short-circuit conductor which shorts the heater wires at the center thereof; and a line element extending toward said first feed terminal from an end of the short-circuit conductor in parallel with said first antenna conductor.

5. A window glass antenna according to claim 4, wherein said heater are wires are divided into upper and lower groups, said short-circuit conductor being provided along the center line of the glass window to short respective centers of said upper group of heater wires.

6. A window glass antenna according to claim 1, wherein auxiliary horizontal elements are extended from the bus bar of the heater wires on the side of the second feed terminal in the upper and lower blank areas of the glass window to improve antenna characteristic of the heater wires.

7. A window glass antenna according to claim 6, wherein an auxiliary horizontal element is extended from the bus bar of the heater wires on the side of the first feed terminal in the lower blank area.

* * * * *

UNITED STATES PATENT AND TRADEMARK OFFICE

CERTIFICATE OF CORRECTION

PATENT NO. : 5,231,410

DATED : July 27, 1993

INVENTOR(S) : Harunori MURAKAMI et al.

It is certified that error appears in the above-indentified patent and that said Letters Patent is hereby corrected as shown below:

At column 3, line 38, insert --short-circuit conductor I0j toward the bus bar 3 so as to-- before the word "couple".

At column 3, lines 43-44, delete "short-circuiting" and insert --short-circuit--.

At column 3, line 54, insert --directivity of the main-- before the word "element".

At column 5, line 18, insert --2-- after the word "wires".

At column 5, line 57, delete "firs" and insert --first--.

At column 6, line 42, delete the first occurrance of the word "are".

Signed and Sealed this

Thirteenth Day of August, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,231,410
DATED : July 27, 1993
INVENTOR(S) : Harunri Murakami & Hidetoshi Oka It is certified that error appears in the above-identified patent and that said Letters Patent is hereby corrected as shown below:

In Claim 1, column 6, line 18 delete "is" before the word "width" and insert --in-.

In Claim 1, column 6, line 21 delete the second occurrence of the word "said" and insert --feed- before the word "terminal"

Signed and Sealed this

Fourth Day of April, 2000

*Attest:*

*Attesting Officer*

Q. TODD DICKINSON

*Director of Patents and Trademarks*